United States Patent [19]

Hoffman

[11] Patent Number: 4,472,151

[45] Date of Patent: Sep. 18, 1984

[54] FLOTATION DEVICE

[76] Inventor: Richard S. Hoffman, 1175 NE. 125 St., #211, North Miami, Fla. 33161

[21] Appl. No.: 515,539

[22] Filed: Jul. 20, 1983

Related U.S. Application Data

[63] Continuation-in-part of Ser. No. 392,552, Jun. 28, 1982, abandoned.

[51] Int. Cl.[3] ..... B63C 9/28

[52] U.S. Cl. ..... 441/127; 441/116

[58] Field of Search ..... 441/88, 106, 108, 111, 441/112, 114, 115, 116, 117, 118, 123, 125, 126, 127, 128

[56] References Cited

U.S. PATENT DOCUMENTS

| | | | |
|---|---|---|---|
| 1,053,472 | 2/1913 | Boatright | 441/111 |
| 3,015,115 | 1/1962 | Medin | 441/115 |
| 3,225,369 | 12/1965 | Berwick | 441/115 |
| 3,727,249 | 4/1973 | Bonthelius | 441/127 |

FOREIGN PATENT DOCUMENTS

| | | | |
|---|---|---|---|
| 79025 | 8/1951 | Denmark | 441/116 |
| 1123941 | 2/1962 | Fed. Rep. of Germany | 441/117 |
| 538557 | 5/1922 | France | 441/111 |

*Primary Examiner*—Trygve M. Blix
*Assistant Examiner*—Thomas J. Brahan
*Attorney, Agent, or Firm*—John C. Malloy

[57] ABSTRACT

A personal flotation device of a type designed and structured to be worn about the head and shoulders and upper body portion of the wearer and capable of supporting the wearer in water in a substantially face upright position to provide adequate breathing space even when the wearer is unconscious. The flotation device is further capable of being closed into a carrying case position and otherwise utilized as various type cushion structures such as a seat with accompanying backrest. The structural components of the device include various buoyant portions capable of being specifically disposed about predetermined portions of the wearer's body so as to properly support the upper chest, head, back and chin portions thereby adequately supporting and orienting the wearer in water when worn.

18 Claims, 19 Drawing Figures

FLOTATION DEVICE

This is a continuation-in-part application of my presently pending application Ser. No. 392,552 filed June 28, 1982, now abandoned.

FIELD OF THE INVENTION

This invention is directed towards a flotation device capable of being worn about predetermined upper portions of the wearer's body and at the same time being converted into a cushion structure for a variety of uses when not utilized as a flotation device, such other uses including a cushioned backrest and other pillow-type cushions.

DESCRIPTION OF THE PRIOR ART

Flotation devices are currently in wide use in the recreational, commercial and military marine areas. In addition, flotation devices having certain structural features and performance characteristics are a legal requirement when utilizing boats and ships of various sizes. Prior art devices exist which meet United States Coast Guard requirements and also which convert into a pillow or cushion-type structure.

The most desirable and commercially popular of these devices have proven to be equally as safe as the standard U.S. Coast Guard Type II personal flotation device (orange life vest). However, the flotation devices currently available do suffer from certain inherent problems which while allowing the devices to be operable, frequently makes these structures less than totally desirable.

The structures of such prior art personal flotation devices are evidenced in the disclosures of the U.S. Pat. Nos. to Brown, 3,065,476, and Vontelaus, 3,727,249.

Regardless of the existence of available personal flotation devices there is still a need in the industry for a flotation device capable of being worn about the head and shoulders of the wearer while at the same time being capable of converting into a cushion-type structure adding both safety and comfort to the user. Such a device should further meet U.S. Coast Guard requirements by being structured and dimensioned to include the ability of turning a submerged unconscious wearer of the device into a face-up orientation, wherein the head of the user or wearer is reclined above the water level to allow for breathing. Such a preferred device should be comfortable when worn, should not cause discomfort or put pressure around the emersed wearer's neck and provide additional comforting application by utilizing a cushioned underarm structure where buoyant pressure is substantially located.

Finally, the device should be adequately positioned about the wearer's chest, back, shoulders and underarms in a manner to provide adequate floating support in an evenly distributed manner and avoid placing pressure only on the wearer's sensitive front neck area. While providing the above-mentioned advantages, the structure of the device should be adaptable to be worn by both adults and children of varying sizes and weight.

SUMMARY OF THE INVENTION

This invention relates to a personal flotation device of a type capable of being worn about the back, chest, head and shoulders of the wearer while at the same time being converted into a cushion-type structure with various applications. More particularly the subject device includes a first buoyant portion which, when worn, fits over the upper front and chest portion of the wearer. A second buoyant portion is movably attached to the first buoyant portion in a substantially end-to-end relation. These two buoyant portions, when not serving as a flotation device, can be disposed as two separate side-by-side pillow-type cushions or alternately positioned in perpendicular relation to one another and thereby serve as a seat with backrest.

More specifically, the second buoyant portion includes a rear support panel capable of being pivoted out of the plane of the second buoyant portion thereby defining an aperture in the second buoyant portion. The remainder of the second buoyant portion provides two shoulder embracing panels disposed on opposite sides of the head of the wearer when the flotation device is mounted or worn. The rear support panel fits beneath the head and about the upper back portion in a manner hereinafter to be described.

The rear support panel includes a head rest portion pivotally attached to a back rest portion both of which are capable of being pivoted into an angular orientation relative to one another so as to adequately support the back of the head of the wearer as well as the upper back portion.

Side panels are provided in movably attached relation to the second buoyant portion by connector means and, when worn, the side panels extend under the respective arms of the wearer into attached relation with the first buoyant portion covering the chest of the wearer. The entire flotation device is secured on the wearer by the provision of connecting belt members attached to the distal end of each side panel and having sufficient length for interconnection with one another through the provision of a belt connecter.

Finally a carrying handle is connected to each buoyant portion in a manner to provide adequate support when the various components of the flotation device are folded over into their closed position. In such a closed position the flotation device may resemble a carrying case or like structure.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 6:
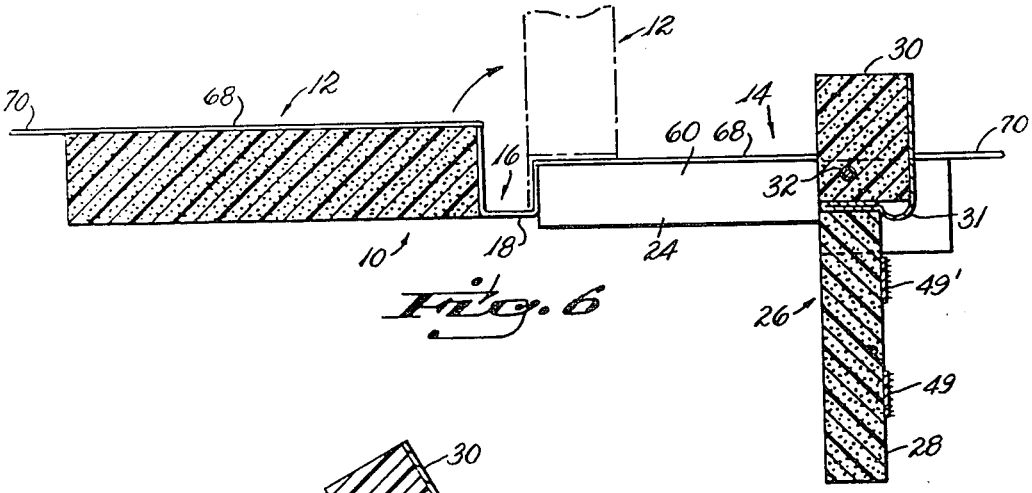
FIG. 6 is a sectional view taken along line 6—6 of FIG. 5 with an alternate position of a first buoyant portion shown in broken lines.

In one preferred embodiment of the present invention the personal flotation device of the present invention is generally indicated as 10 and comprises a first buoyant portion generally indicated as 12 and a second buoyant portion generally indicated as 14 pivotally and hingedly attached to each other by strap means generally indicated as 16. The strap means more specifically comprises a plurality of strap elements 18 disposed to interconnect buoyant portions 12 and 14 in an end-to-end relation with one another. In addition, the connecting straps 18 are sufficiently dimensioned and disposed to allow a perpendicular orientation of the first and second buoyant portions 12 and 14 respectively relative to one another as shown in broken lines in FIG. 6. This structure allows the subject device to be utilized as a cushioned seat with cushioned backrest when not being utlized as a personal flotation device.

Additional structure features of the first buoyant portion 12 includes substantially bevelled lateral edges 20 for the purposes of additional comfort as well as serving to interconnect the various components of the flotation device when in use, as will be explained in greater detail hereinafter. The second buoyant portion comprises shoulder embracing elements 22 and 24 disposed in substantially parallel spaced apart relation to one another and disposed to fit on opposite sides of the head of the wearer and rest on the shoulders thereof (FIGS. 8–11) when in use.

Figure 7:
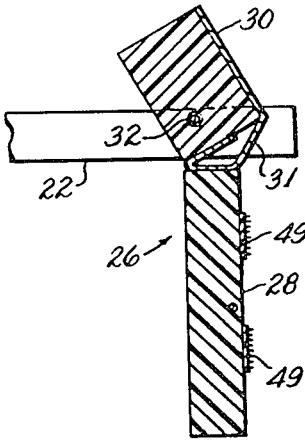
FIG. 7 is a sectional view in partial cut-away showing relative orientations of components of the rear support panel.

The second buoyant portion also includes a rear support panel generally indicated as 26. The rear support panel is at least partially defined by a backrest portion 28 and a headrest portion 30. These two aforementioned portions are interconnected by a flexible connecting strap or like element 31 thereby allowing pivotal movement or angular inclination of the two elements relative to one another as best shown in FIG. 7.

With reference to FIGS. 2, 5, 6 and 7 pivotal movement of the rear support panel 26 out of the plane of the second buoyant portion 14 and also pivotal movement of the headrest portion 30 is at least partially provided by a securing rod or shaft 32 having its ends anchored or secured in the shoulder embracing portions 22 and 24 and its middle portion passing through the headrest portion of 30. Pivotal movement and relative displacement of the components relative to one another in the aforementioned manner is thereby provided by virtue of this structure.

Each of the side panels 34 and 36 is connected to the second buoyant portion by a tether or flexible cord element 38. In the closed or at least partially closed position of the flotation device the side panels 34 and 36 are disposed in a folded over, side-by-side relation to one another defining at least a portion of the overall mass of the second buoyant portion (See FIG. 12). In their outwardly extended or open position, the side panels 34 and 36 may be displaced outwardly from the sides or lateral edges of the second buoyant portion and are disposed to pass underneath the arms of the wearer in a buoyant or supporting position (See FIGS. 10 and 11). The opposite or distal ends 39 are attachable to a connector 40 secured to the lateral bevelled edges 20 of the first buoyant portion. This connecter may be the conventional hook and loop-type fastener, commercially available under the tradename Velcro, in order to provide proper securement.

Figure 8:
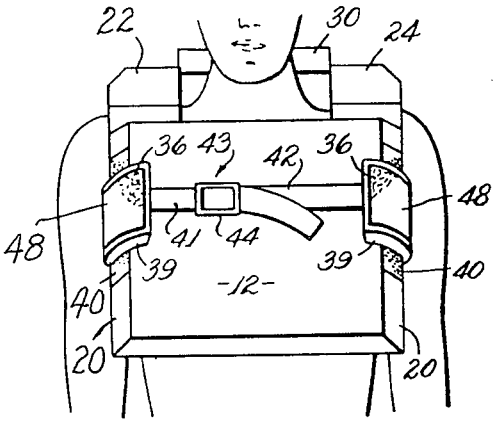
FIG. 8 is a front view of the flotation device when worn.

To secure the entire flotation device in its intended disposition on the wearer, a connecting belt 41 and 42 extends from the distal ends 39 of each side panel 34 and 36 into removably connected engagement with one another. This engagement is provided through a belt connecter generally indicated as 43 which may be a buckle-type fastener 44 as shown in FIG. 8.

Figure 3:
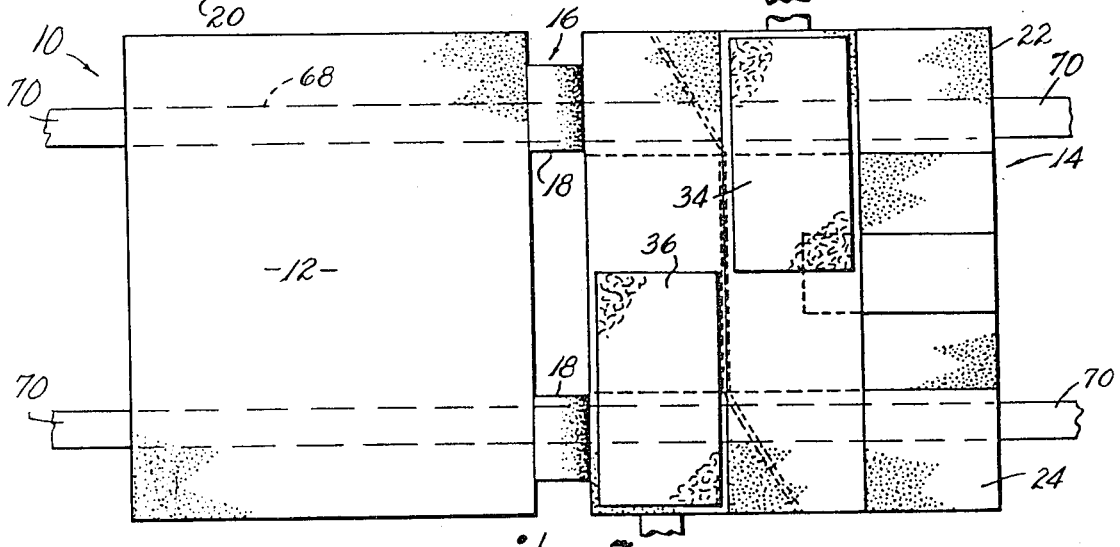
FIG. 3 is a front plan view of the inner surface of the subject device in its open folded outer position.
Figure 9:
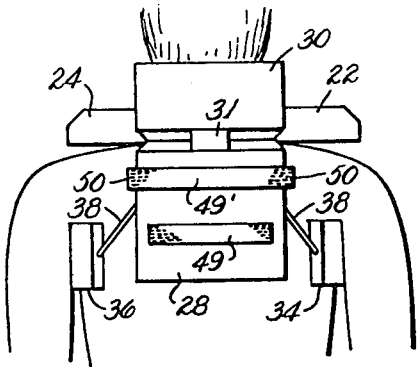
FIG. 9 is a rear view of the flotation device when worn.

With regard to FIG. 9 the various side panels have their exposed surfaces, at least in part, defined by additional hook and loop-type fasteners 48, of the type set forth above, which matingly engage connecter strips 49 and 49' located on the exposed surface of backrest portion 28. The inter-engagement of the connecters 48 with the connecter strips 49 and 49' provide for a secure disposition of the side panels 34 and 36 when disposed in their closed position (See FIGS. 3 and 12).

Figure 4:
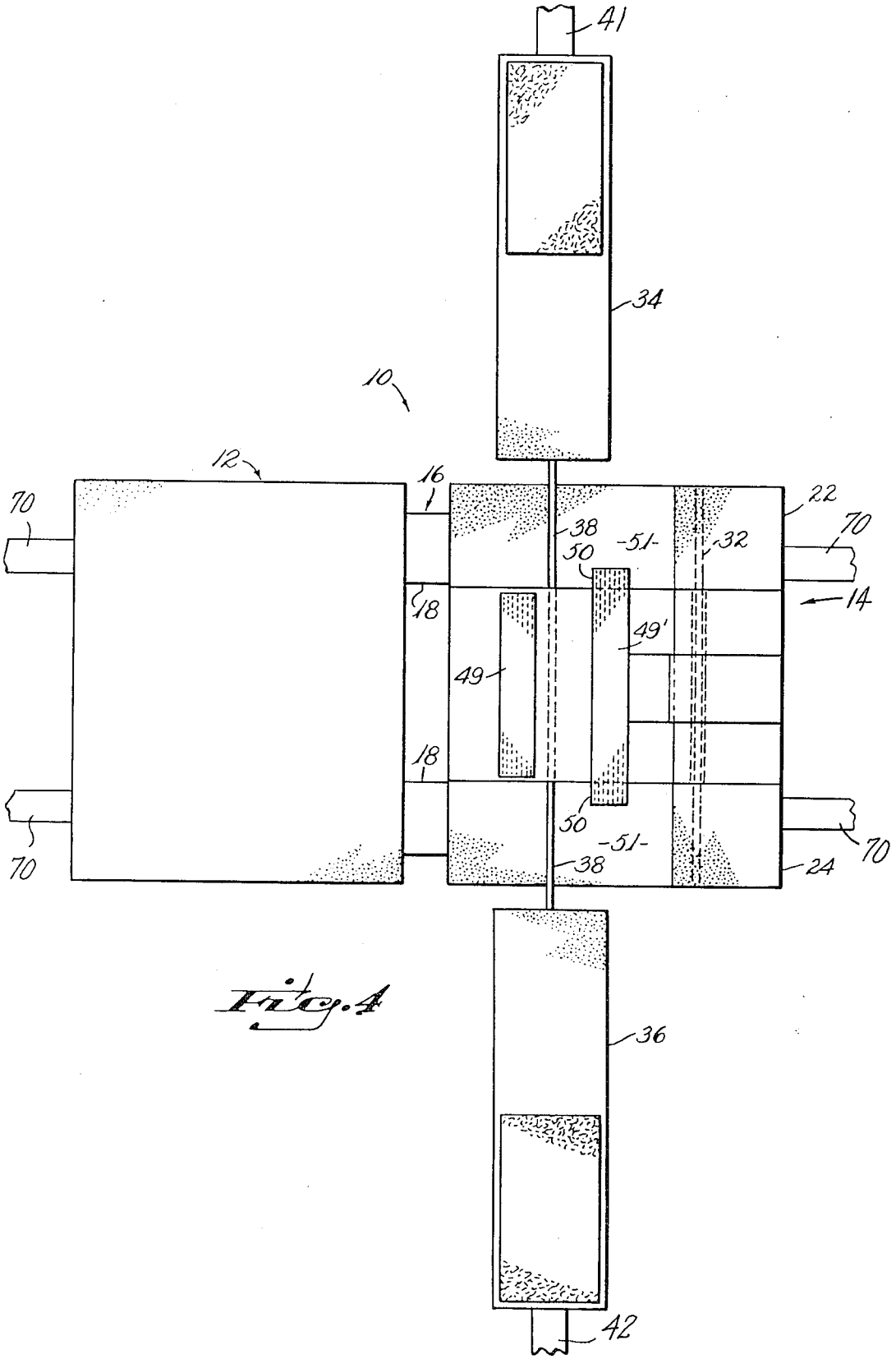
FIG. 4 is a front plan view of the subject device with the side panel components thereof in their outwardly extended position.
Figure 5:
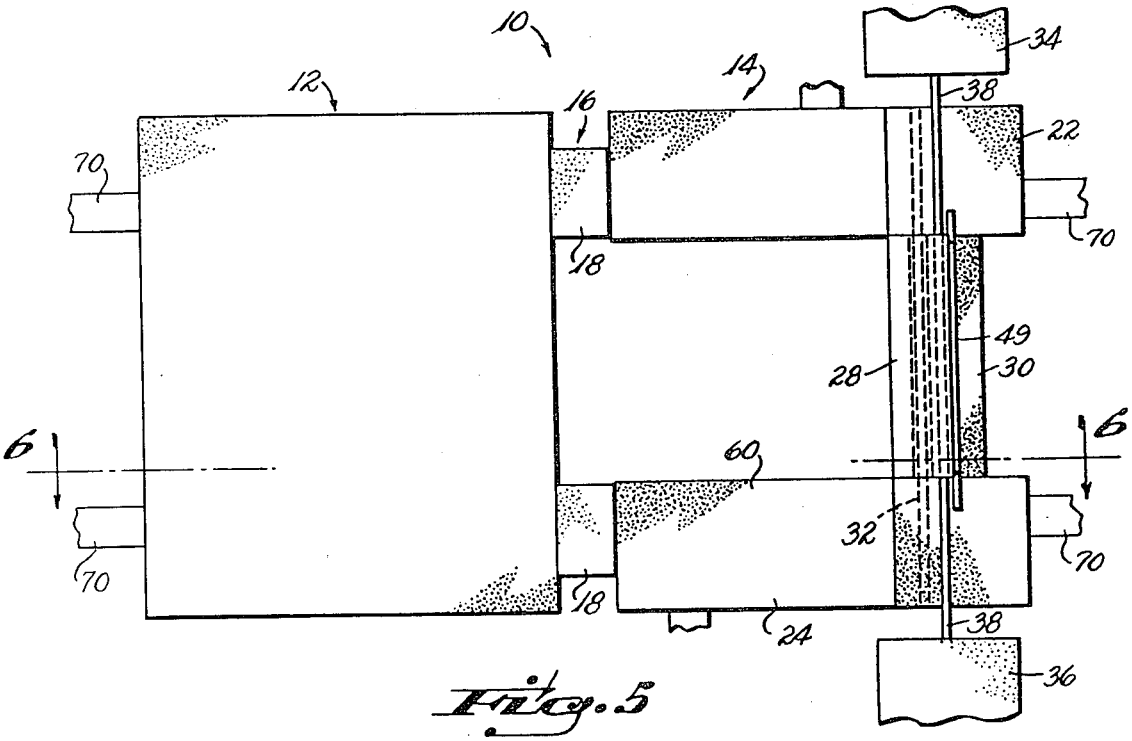
FIG. 5 is a front plan view in partial cut-away of the outer surface of the device with the rear support panel and the side panel exposed in their outwardly extended position.

Further structural features of the present invention include stop means 50 extending outwardly from the connecter strip 49 (See FIG. 9). These stop elements are further disposed so as to abut against surface 51 (FIG. 4) of the shoulder embracing panels 22 an 24. This abutting relation prevents pivotal movement of the rear support panel 26 entirely through the remainder of the second buoyant portion 14.

Pivotal movement of the rear support panel 26 in the intended supporting position (FIG. 6) at least partially defines the mounting aperture 60 through which the head of the wearer may pass.

Figure 10:
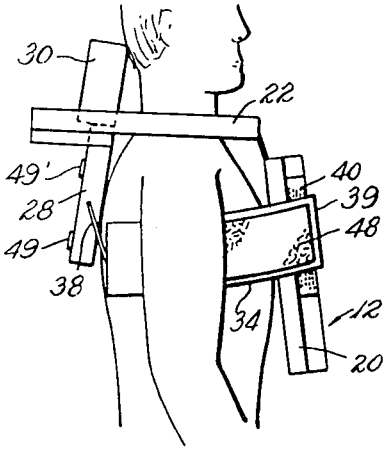
FIG. 10 is a side view of the flotation device when worn.
Figure 11:
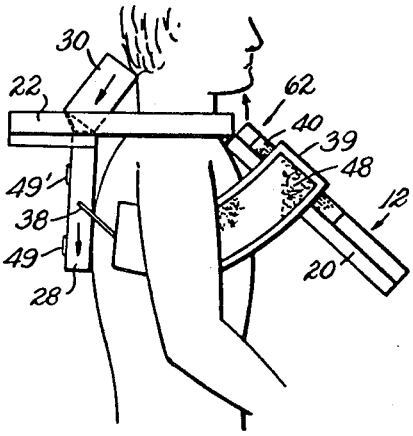
FIG. 11 is a side view of the flotation device showing the relative orientation of the various components to provide proper support to the back, head, chin and chest of the wearer.
Figure 12:
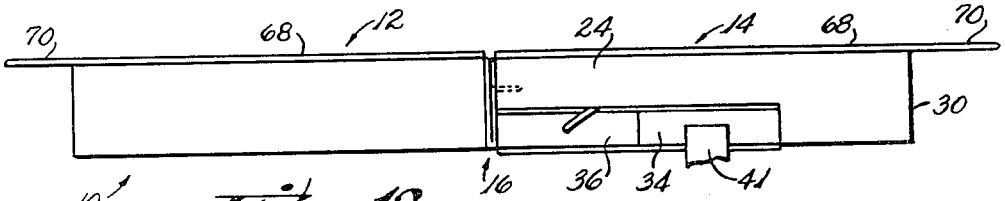
FIG. 12 is a side view of te embodiment of FIG. 3 of the device.

As shown in FIGS. 10 and 11, when worn, the head of the wearer passes through the aperture 60 such that the shoulder embracing panels 22 and 24 are positioned on the shoulders on the opposite sides of the head of the wearer. The aperture 60 is opened to its maximum dimension thereby providing easy access. However, when the flotation device is used to support the wearer in water the various components are oriented into their maximum support position. This maximum support position may be defined by the upward and outward location of the bottom of the first buoyant portion such that the upward part 62 is diposed in chin supporting relation. Further, the back supporting portion 28 properly supports the upper back and the headrest portion 30 serves as a support for the force exerted thereon by the back of the head of the wearer.

Other structural features of the present invention (FIG. 6) include a carrying element 68 affixed to the designated surfaces of both the first and second buoyant portions. A loop or handle 70 is defined by the outward extension of strap 68 at opposite ends of the first and second buoyant portions 12 and 14 respectively.

Figure 1:
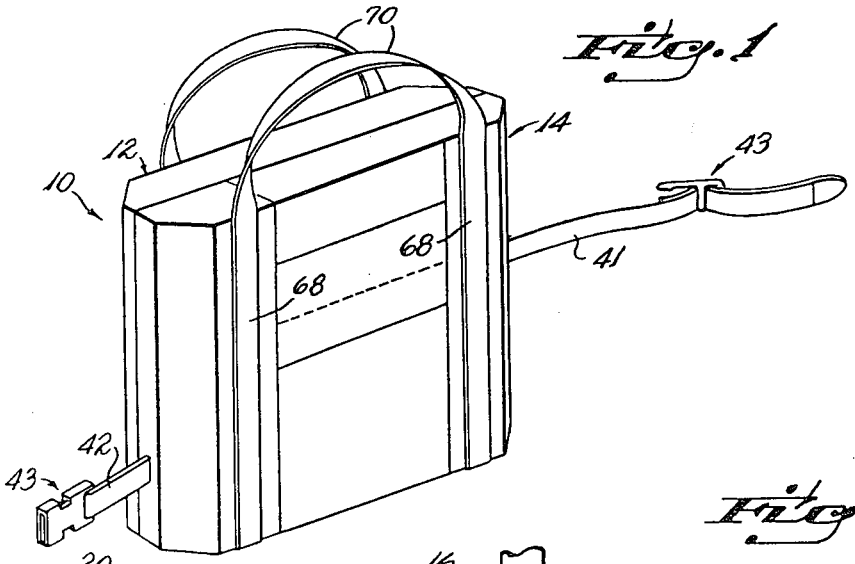
FIG. 1 is an isometric view of the flotation device in its closed position.
Figure 2:
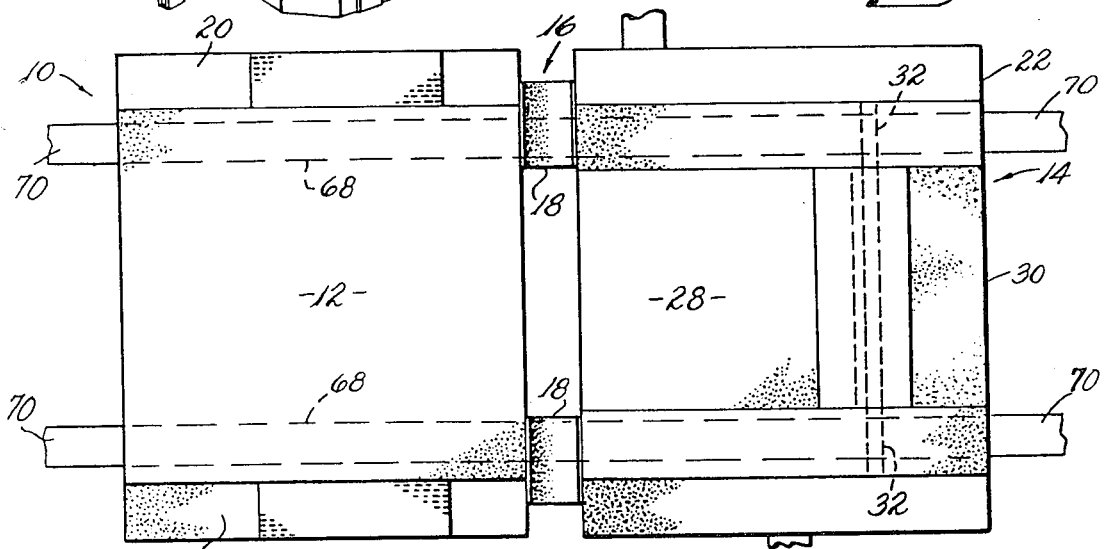
FIG. 2 is a front plan view of the outer surface of the subject device in its open position.

As best shown in FIG. 1, the handle element or handle loop 70 are thereby disposed in cooperative grasping relation when the flotation device is arranged in its closed position for easy pillow case-type carrying of the structure.

With regard to FIGS. 14 through 19 another preferred embodiment of the present invention is represented generally at 10 (see FIG. 13) and includes a first buoyant portion 12 and a second or rear buoyant portion generally indicated a 14. These two buoyant portions are interconnected by a plurality of strap elements 18 similar to the embodiment of FIG. 4.

Figure 13:
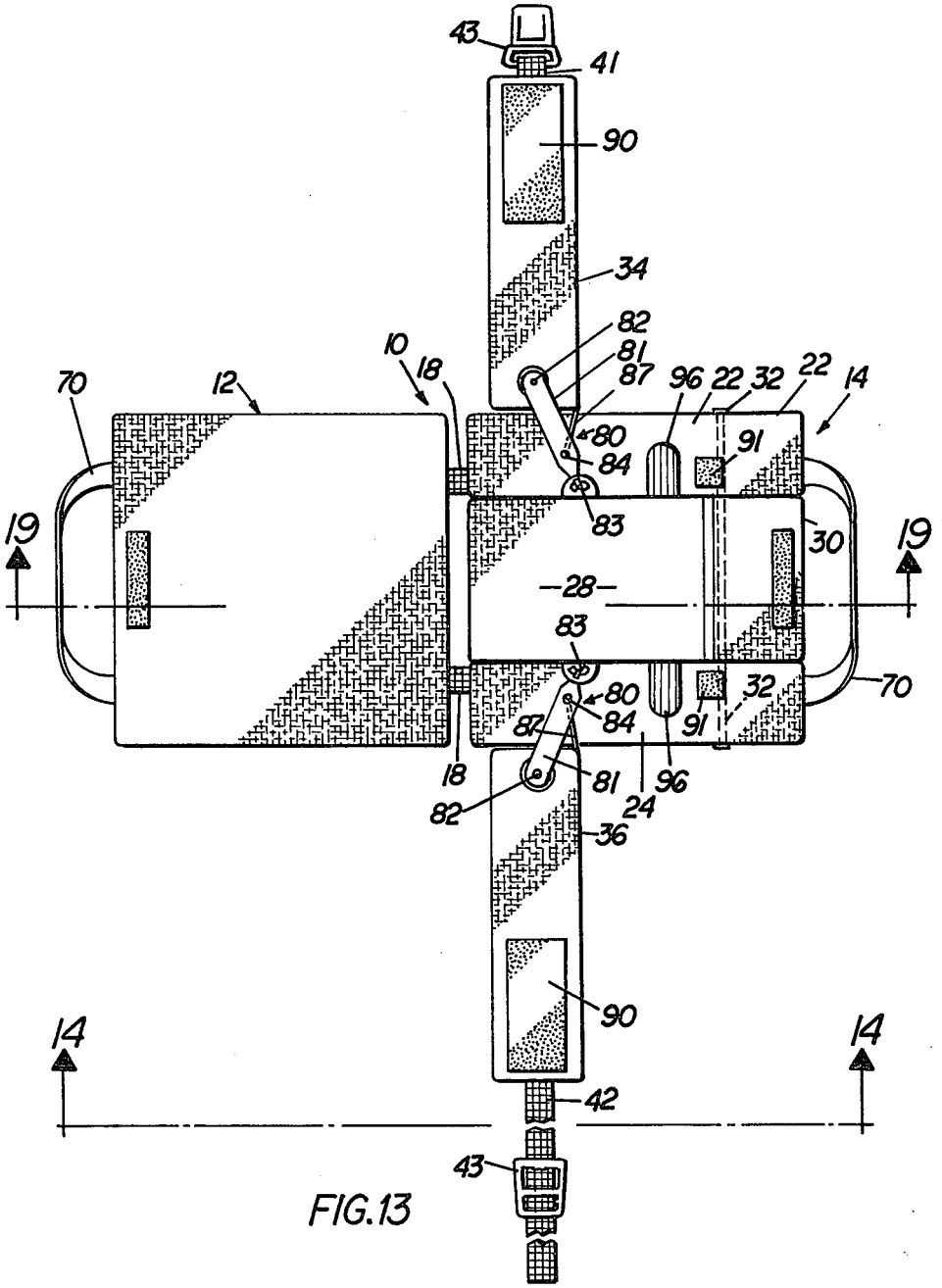
FIG. 13 is a front plan view of another embodiment of the present invention.
Figure 14:
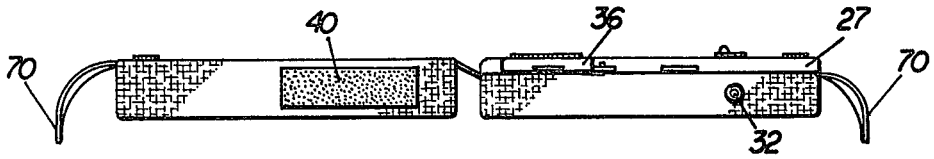
FIG. 14 is an end view in partial section along line 14—14 of FIG. 13.
Figure 15:
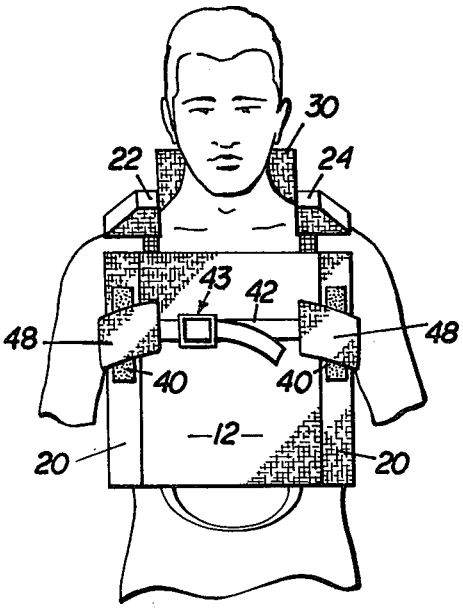
FIG. 15 is a front plan view of the embodiment of FIG. 13 mounted on a wearer.
Figure 17:
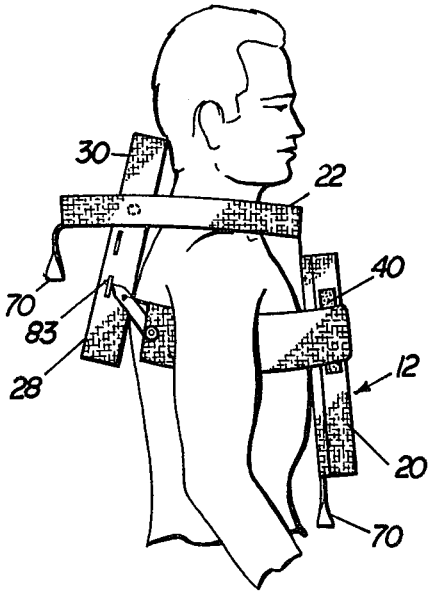
FIG. 17 is a right side view of the embodiment of FIG. 15.
Figure 18:
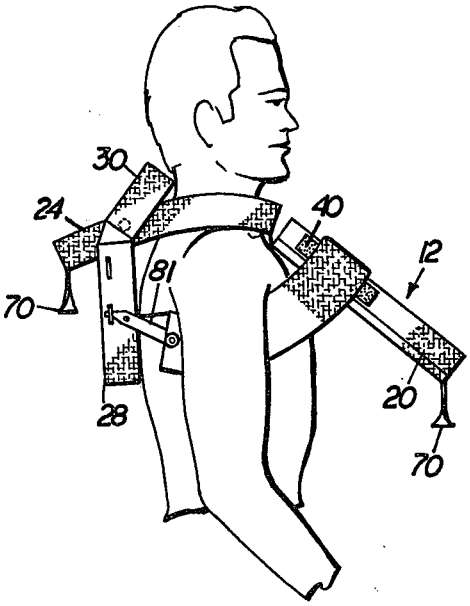
FIG. 18 is a right side view of the embodiment of FIG. 15 wherein the flotation device is in its supporting position relative to the wearer.
Figure 19:
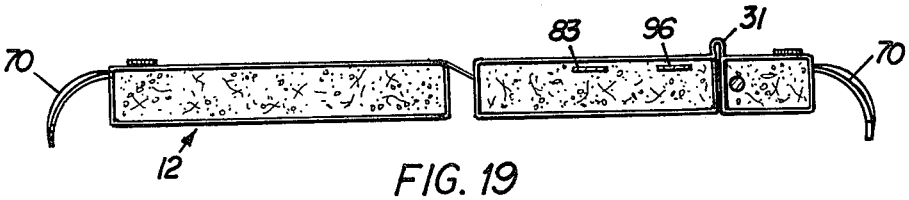
FIG. 19 is a sectional view along line 19—19 of FIG. 13.

The second buoyant portion 14 comprises a rear support panel including a headrest portion 30 and a backrest portion 28. These two portions are similarly pivotally connected so as to offer support to the back of the neck and/or the head of the wearer of the flotation device as best shown in FIGS. 17 and 18. A connecting or pivot rod 32 serves to allow relative pivotal movement of the headrest 30 relative to the backrest portion 28. Structural differences in the two embodiments are primarily directed towards the provision of side panels 34 and 36. In the embodiment of FIG. 13, the side panels 34 and 36 are disposed in spaced apart, substantially parallel relation to one another on opposite sides of the rear support panel as shown in FIGS. 13 and 14. When the flotation device 10 is in its closed position, the side panels overlie respectively positioned shoulder panels 22 and 24. With reference to FIG. 14, side panel 36 is designed to pivot into its overlying relation within a substantial socket means 27.

Figure 16:
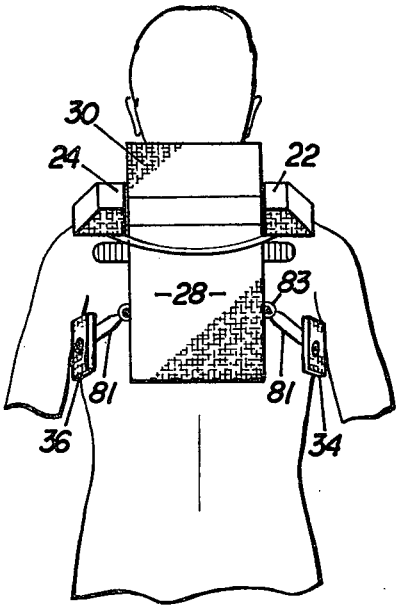
FIG. 16 is a rear view of the embodiment of FIG. 15.

Also, means of connecting the side panels 34 and 36 include hinge means generally indicated as 80 wherein each hinge means includes a hinge link 81 having its outermost end as at 82 pivotally attached to the correspondingly disposed end of the side panels 34 and 36. The opposite ends as at 83 are movably or pivotally connected to the backrest portion 28 as shown in FIGS. 13, 16 and 17. Further, a restriction means or limit means includes a cord element 87 attached to link 81 as at 84 and attached to the respective side panels 34 and 36 at its opposite end. This restricting cord limits the movement or positioning of the side panels before connecting the side panels to one another as shown in FIGS. 15 through 18. Thereby in an emergency situation, the wearer of the device can readily find the side panels and cause their interconnection about the first buoyant portion 12 as shown in FIGS. 15 through 18. In order to maintain the side panels 34 and 36 in their closed position, Velcro fasteners 90 located on each of the side panels 34 and 36 are disposed to cooperate with smaller dimensioned but correspondingly positioned Velcro fasteners 91 on the exposed surfaces of the shoulder panels 22 and 24 as shown in FIG. 13. Accordingly, when the side panels are in their closed position and the flotation is totally closed for storage as in FIG. 1 the side panels are effectively sandwiched between the first buoyant portion 12 and the second buoyant portion 14. Further structural features of the additional preferred embodiment as shown in FIG. 13 is the inclusion of outwardly extending stop elements 96 which are disposed between the side panels 34 and 36 and the respective shoulder panels 22 and 24 on which they overlay. Accordingly, easy dislodgement or removal of the side panels into their connecting position (FIG. 13) is accomplished merely by pulling free the rear support panel from the second buoyant portion 14 in order to form the aperture through which the wearer's head passes. The pivotal movement of the rear support panel in the manner described serves to totally dislodge the side panels 34 and 36 from their respectively positioned shoulder panels since the outwardly or laterally extending stop elements 96 disengage the two hook-and-loop type fasteners 90 and 91 located on the side panels and the shoulder panels as set forth above.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A personal flotation device of the type capable of being selectively converted into a support cushion or like structure, said device comprising: a first and a second buoyant portion pivotally connected to one another in an end-to-end relation, said second buoyant portion comprising a rear support panel pivotally attached to the remainder of said second buoyant portion and positionable from a substantially coplanar disposition with the remainder of said second portion into a substantially back supporting position when worn, an aperture formed in said second buoyant portion and defined by disposition of said rear support panel into said back supporting position, said aperture dimensioned and structured to fit over the head of the wearer; the first buoyant portion defining a front, chest covering panel; said second buoyant portion further comprising two shoulder panels each located on opposite sides of and at least partially defining boundaries of said aperture; said rear support panel comprising a head rest portion and a back rest portion positionable in substantially coplanar relation to one another when disposed within said aperture, said backrest portion pivotal outwardly from said shoulder panels into head supporting position and said backrest portion pivotal outwardly from said shoulder panels into back supporting position, and means on said device to connect to a wearer's body, whereby when worn, said device provides adequate flotation support of the wearer in water.

2. A personal flotation device as in claim 1 further comprising two side panels each positionable in interconnecting relation between said backrest portion and said first buoyant portion under respective arms of the wearer when said flotation device is in an open position and further disposable in overlying relation to said second portion and in substantially coplanar relation with said second buoyant portion when said flotation device is disposed in its closed position.

3. A personal flotation device as in claim 2 further comprising stop means mounted on said backrest and extending outwardly from the lateral portions thereof into abutting relation with a remainder of said second buoyant portion when said rear support panel is in substantially coplanar relation with the remainder of said second buoyant portion, whereby said rear support panel is prevented from passing through said aperture.

4. A personal flotation device as in claim 3 wherein said stop means comprises two stop elements each extending laterally outward from an opposite lateral portion of said backrest and each positioned between one of said shoulder panels and one of said side panels, said backrest and said attached stop elements structured and relatively disposed to cause dislodgement of said side panels from said shoulder panels upon movement of said rear support panel to said back supporting position.

5. A personal flotation device as in claim 2 wherein said two side panels are disposed in a substantially side-by-side, parallel relation to one another and in overlying relation to said second buoyant portion and in substantially sandwiched relation between said first and said second buoyant portions when said flotation device is disposed in its closed position.

6. A personal flotation device as in claim 2 wherein said headrest portion comprises a greater thickness than said backrest portion, a storage space means for said side panel being defined by the thickness differences between said headrest portion and said backrest portion, said storage space dimension and the thickness of said side panel being substantially equal, whereby respectively positioned exposed surfaces of said side panels and said headrest are substantially coplanar with one another and at least partially defined an exposed surface of said second portion.

7. A personal flotation device as in claim 2 further comprising hinge means attached to said rear support panel and to correspondingly position ends of each side panel, each of said side panels movably connected to said rear support panel and further including connecting means mounted on opposite ends of said side panels and to said hinge means and structured for attachment to said first buoyant portion.

8. A personal flotation device as in claim 7 wherein said hinge means further comprises a flexible tether attached to said backrest portion and to said ends of each of said side panels, whereby selective movement occurs between each of said side panels and said backrest portion.

9. A personal flotation device is in claim 7 further comprisng securing means including a belt portion secured to and extending outwardly from the distal ends of each side panel, each belt portion having a length sufficient to extend into attachment with the other of said belt portions belt connecter means secured to at least one of said belt portions and structured to permanently secure said belt portions to one another.

10. A personal flotation device as in claim 2 wherein said hinge means comprises hinge link having opposite ends each pivotally attached to said side panels and said backrest respectively, each of said side panels connected for a limited range of movement of said side panels relative to said backrest portion into attached relation to said first buoyant portion when said flotation device is in said open position.

11. A personal flotation device as in claim 10 wherein said hinge link is substantially rigid along the longitudinal axis thereof, limit means interconnected between said correspondingly positioned end of each side panel and said hinge link along the length thereof, said limit means comprising a chord element dimensioned and disposed to limit movement of each of said side panels relative to said backrest.

12. A personal flotation device as in claim 1 further comprising flexible strap means serving to hingedly connect said headrest portion to said backrest portion thereby allowing for angular inclination of said headrest portion relative to said backrest portion in supporting positioning behind the rear portion of the head of the wearer.

13. A personal flotation device as in claim 1 wherein said first buoyant portion is structured and positioned for upward movement towards the wearer's chin and outward movement away from the wearer's chest into substantially supportive relation relative to the chin of the wearer.

14. A personal flotation device as in claim 1 wherein said first buoyant portion comprises a greater overall mass and dimension than said rear support panel including said headrest portion and said backrest portion, whereby said flotation device tends to orient a wearer thereof in a face-up position when floating in water.

15. A personal flotation device as in claim 1 wherein said two side panels are disposed in spaced apart, substantially parallel relation to one another on opposite sides of said rear support panel and in substantially sandwiched relation between said first and said second buoyant portion when said flotation device is disposed in its closed position.

16. A personal flotation device as in claim 15 wherein said second buoyant portion further comprises two shoulder panels each located on opposite sides of and at least partially defining said aperture, said side panels each disposed in overlying relation to one of said shoulder panels, and in sandwiched relation between said first buoyant portion ation and respective ones of said shoulder panels when said flotation device is in its closed position.

17. A personal flotation device as in claim 15 wherein said side panels are each disposed in overlying relation to one of said shoulder panels, and in sandwiched relation between said first buoyant portion and respective ones of said shoulder panels when said flotation device is in its closed position.

18. A personal flotation device as in claim 17 wherein each of said shoulder panels and respective ones of said overlying side panels collectively are of substantially equal thickness to said rear support panel and are collectively substantially coplanar therewith, said spaced apart side panels at least paritally defining an exposed surface of said second buoyant portion.

* * * * *